US006647557B2

(12) United States Patent
Chou

(10) Patent No.: US 6,647,557 B2
(45) Date of Patent: Nov. 18, 2003

(54) WATERPROOF GOGGLES

(76) Inventor: Terry Chou, No. 12, Hsin Ho Herng Rd., Tainan City, Taiwan (CN)

( * ) Notice: Subject to any disclaimer, the term of this patent is extended or adjusted under 35 U.S.C. 154(b) by 3 days.

(21) Appl. No.: 10/098,719

(22) Filed: Mar. 18, 2002

(65) Prior Publication Data

US 2003/0172443 A1 Sep. 18, 2003

(51) Int. Cl.[7] ..... A61F 9/02
(52) U.S. Cl. ..... 2/442; 428/426
(58) Field of Search ..... 2/12, 13, 15, 428, 2/426, 429, 434, 441, 442, 443, 436, 437, 444, 445, 446, 431, 440, 439, 435, 8, 9, 171.3; 351/57, 62, 158, 43, 41, 47, 110

(56) References Cited

U.S. PATENT DOCUMENTS 6,052,834 A * 4/2000 Chou ..... 2/428
6,098,206 A * 8/2000 Chou ..... 2/428
6,343,386 B1 * 2/2002 Chou ..... 2/428

* cited by examiner

*Primary Examiner*—Gary L. Welch
(74) *Attorney, Agent, or Firm*—Charles E. Baxley

(57) ABSTRACT

A pair of waterproof goggles comprises two lenses made of a transparent rigid material, two padding members made of a soft material, two frames, a bridge, and a head strap. Each lens includes an annular groove in an outer periphery thereof. Each padding member includes an engaging portion on a side thereof for receiving a flange of the associated lens. Each padding member further includes a padding portion. The frames and the bridge are integrally formed of a material that is slightly stretchable. Each frame further includes a receiving portion for clamping a bottom wall defining the annular groove of the associated lens. Each frame has an inner edge that is completely received in the annular groove of the associated lens, thereby allowing easy, reliable assembly and providing improved pull-resistance through use of the slightly stretchable frames.

3 Claims, 13 Drawing Sheets

WATERPROOF GOGGLES

BACKGROUND OF THE INVENTION

1. Field of the Invention

The present invention relates to a pair of waterproof goggles in which the convenience of assembly, reliability, support, and wearing comfort are improved.

2. Description of the Related Art

FIGS. 8 and 9 of the drawings illustrate a pair of conventional waterproof goggles comprised of two lenses 1', two padding members 2', a bridge 3', and a head strap 4'. Each lens 1' is made of a transparent rigid material and a includes an engaging portion 11' for engaging with an associated padding member 2'. Each lens 1' further includes an inner engaging section 12' for engaging with the bridge 3' and an outer engaging section 13' for engaging with an associated end of the head strap 4'. Each padding member 2' is made of a stretchable soft material and includes a lens-receiving portion 22' having an inner diameter smaller than an outer diameter of the engaging portion 11' of the associated lens 1' for receiving the engaging portion 11' of the associated lens 1' by means of stretching the lens-receiving portion 22'. Further, each padding member 2' includes a flange 23' on a side 22' thereof for intimate contact with a user's eye socket. A better wearing comfort is obtained, as the flange 23' is made of soft material. However, the engagement between the padding members 2' and the lenses 1' was found unreliable such that leakage was apt to occur as a result of disengagement therebetween. Further, the lenses 1' and the bridge 3' as a whole fail to provide an aesthetically pleasing appearance, as they are separate elements.

FIG. 10 illustrates another pair of conventional waterproof goggles comprised of two lenses 5', an integral frame 6', a bridge 7', and a head strap 8'. Each lens 5' is made of a transparent rigid material and includes an edge that is coupled with the frame 6' through proper engagement, bonding, or other means. The frame 6' and the bridge 7' are made of a soft material. Further, the frame 6' includes two padding portions 61' each having an annular resilient sidewall 611' with a socket engaging portion 612' for intimate contact with a user's eye socket, thereby improving the wearing comfort. Since the sidewall 611' of each padding portion 61' is integrally formed of a material the same as that for the frame 6' and the bridge 7', this material must be very soft when softness of the padding portion 61' is the primary consideration. However, as illustrated in FIG. 11, the frame 6' and the bridge 7' would deform largely when the head strap 8' is pulled. On the other hand, if the material is chosen among rigid ones to prevent the undesired deformation, the frame 6' and the bridge 7' are too rigid to provide the required wearing comfort. Thus, it is improper to form the frame 6' and the padding portions 61' as an integral member.

FIGS. 12 and 13 illustrate a further pair of conventional waterproof goggles comprised of two lenses 91', two padding members 92', two frames 93', a bridge 94', and a head strap 95'. Each lens 91' is made of a transparent rigid material and includes an engaging portion 911'. Each padding member 92' is annular and made of a stretchable soft material. Each padding member 92' has a hollow engaging portion 921' with an inner diameter smaller than a diameter of an associated lens 91'. Further, each padding member 92' includes a padding portion 922' configured according to the contour of a user's face. The padding member 92' can be stretched for allowing insertion of the engaging portion 911' of the lens 91' into the engaging portion 92 1'. The frames 93' and the bridge 94' are integrally made of a material that is slightly flexible and that is less stretchable than the padding members 92'. Each frame 93' has an inner diameter slightly smaller than a diameter of the associated lens 91'. Further, each frame 93' includes a lens receiving portion 931' that is substantially U-shaped in section. Further, each frame 93' has an outer portion 932' for engaging with an associated end of the head strap 95'. After engagement between the padding members 92' and the lenses 91', the lens-receiving portion 931' of each frame 93' can be stretched for receiving the engaging portion 911' of the associated lens 91' while clamping the engaging portion 921' of the associated padding member 92' in place. However, as illustrated in FIG. 13, in assembly, each frame 93' must be stretched for simultaneously receiving the associated padding member 92' and the associated lens 91'. Thus, the assembly procedure is difficult to proceed with if the frame 93' is made of a material having a poor stretchability. Theoretically, the less stretchable the frame 93' is, the better pull-resistance the frame 93' has. However, since the frame 93' must be stretched to a certain extent in response to the thickness of the associated padding member 92' so as to simultaneously receive the associated padding member 92' and the associated lens 91', the material with small stretchability cannot be used for making the frame 93'. As a result, the pull-resistance of the frame 93' is insufficient in some cases. Further, since the material for the frames 93' is far more rigid than that for the padding members 92' and since the lens-receiving portion 931' of each frame 93' is mounted around the padding portion 922' of the associated padding member 92', the width a (FIG. 13) of the resilient wall of the padding portion 922' is limited. When wearing, as illustrated in FIG. 14, each padding portion 92' is moved toward the user's eye socket for intimate contact, the padding portion 922' directly presses against the associated rigid frame 93' (see reference numeral b in FIG. 14), the wearing comfort is lost.

SUMMARY OF THE INVENTION

An object of the present invention is to provide a pair of waterproof goggles in which the convenience of assembly, reliability, support, and wearing comfort are improved.

A pair of waterproof goggles in accordance with the present invention comprises two lenses made of a transparent rigid material, two padding members made of a soft material, two frames, a bridge, and a head strap. Each lens includes a flange on a side thereof. Each lens further includes an annular groove in an outer periphery thereof. Each padding member includes an engaging portion on a side thereof for receiving the flange of an associated. lens. The engaging portion has an inner diameter smaller than a diameter of the flange of the associated lens. Each padding member further includes a padding portion configured to conform a contour of a user's face.

The frames and the bridge are integrally formed of a material that is slightly stretchable. Each frame includes an outer portion for engaging with an associated end of the head strap. Each frame further includes a receiving portion for clamping a bottom wall defining the annular groove of the associated lens. Each frame has an inner edge that is completely received in the annular groove of the associated lens, thereby allowing easy, reliable assembly and providing improved pull-resistance through use of the slightly stretchable frames. The padding portion of each padding member has a distance to the engaging portion of the padding member to thereby prevent the padding portion from pressing against an associated one of the rigid lenses, allowing wearing comfort.

In a modified embodiment, the engaging portion of each padding member has an inclined abutting face, and the receiving portion of each frame has a complimentary abutting face such that the inclined abutting face of each padding member is in tight face-to-face engagement with the complimentary abutting face of an associated frame. The receiving portion of each frame presses against the engaging portion of the associated padding member to thereby improve the assembling reliability for the padding members.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
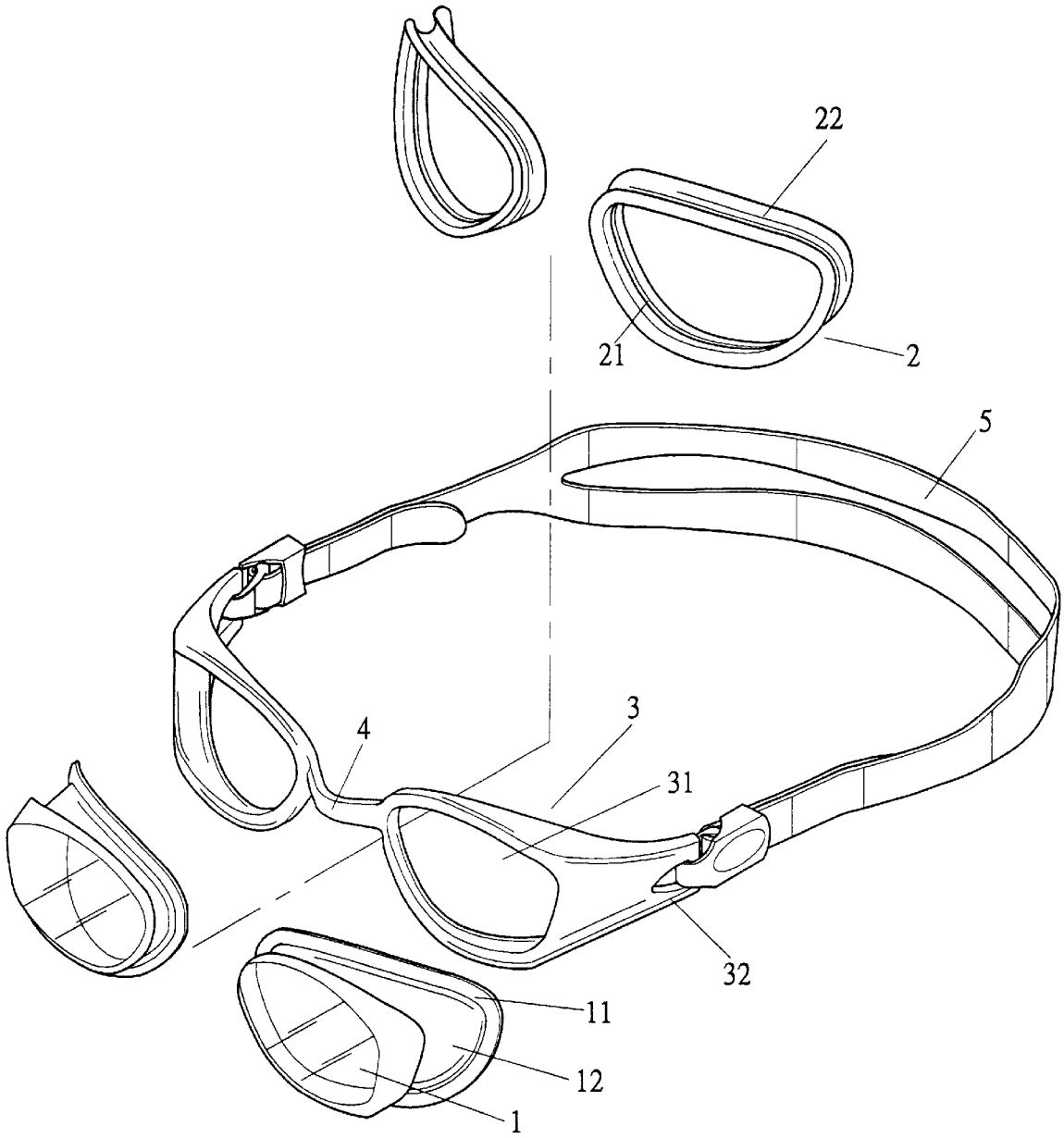
FIG. 1 is an exploded perspective view of a pair of waterproof goggles in accordance with the present invention.
Figure 2:
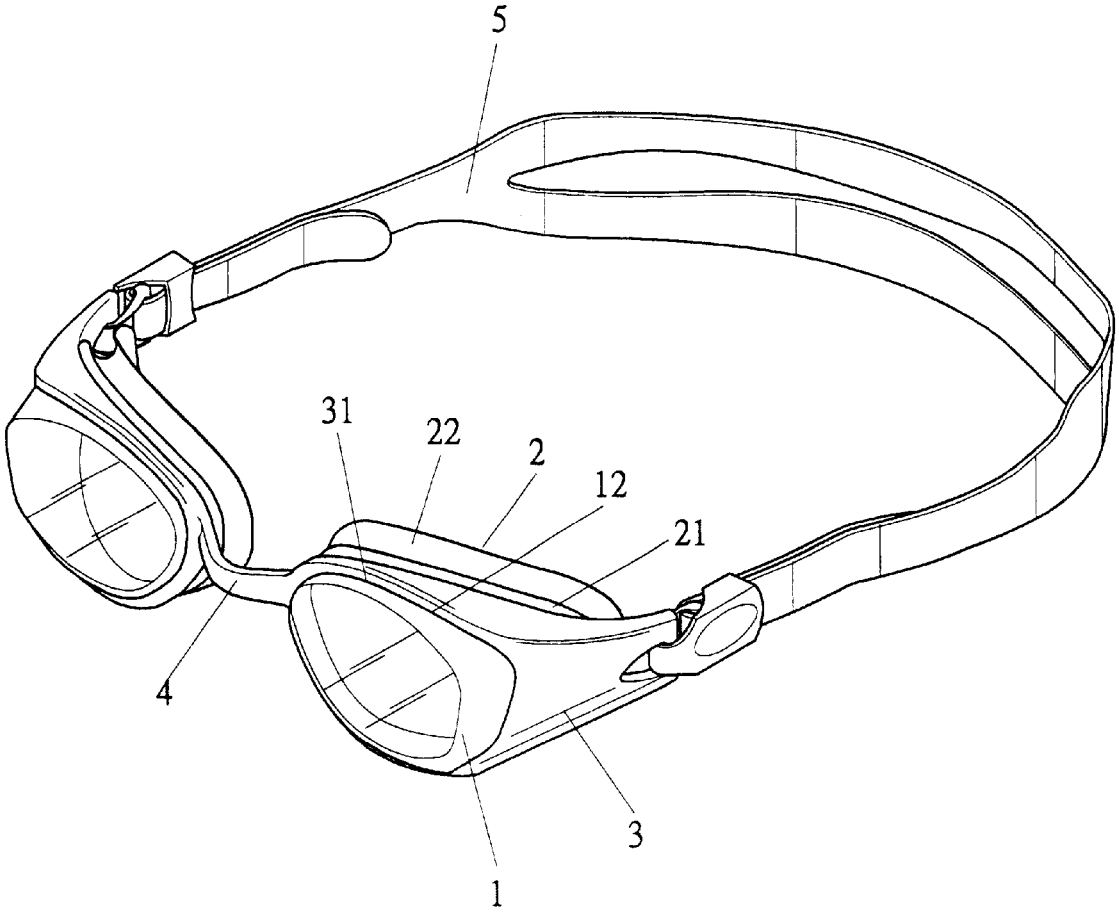
FIG. 2 is a perspective view of the pair of waterproof goggles in accordance with the present invention.

Referring to FIGS. 1 and 2, a pair of waterproof goggles in accordance with the present invention generally comprises two lenses 1, two padding members 2, two frames 3, a bridge 4, and a head strap 5.

Each lens 1 is made of a transparent rigid material and includes a flange 11 on an inner side thereof for engagement with an associated padding member 2. An annular groove 12 is defined in an outer periphery of the lens 1.

Each padding member 2 is made of a soft material with a higher stretchability. Each padding member 2 includes an engaging portion 21 on a side thereof, the engaging portion 21 having an inner diameter smaller than a diameter of the flange 11 of an associated lens 1. Further, each padding member 2 includes a padding portion 22 that is configured to conform the contour of a user's face. Thus, the engaging portion 21 of the padding member 2 can be mounted around the flange 11 of the associated lens 1 through the stretchability of the padding member 2.

The frames 3 and the bridge 4 are integrally formed of a material that is slightly flexible and slightly stretchable. Each frame 3 includes a receiving portion 31 for clamping a bottom wall defining the annular groove 12 of the associated lens 1. The thickness of the receiving portion 31 is smaller than a width of the annular groove 12 of the associated lens 1. It is noted that a bottom of the receiving portion 31 is completely received in the annular groove 12 of the associated lens 1. Further, each frame 3 includes an outer portion 32 for engaging with an associated end of the head strap 5.

Figure 3:
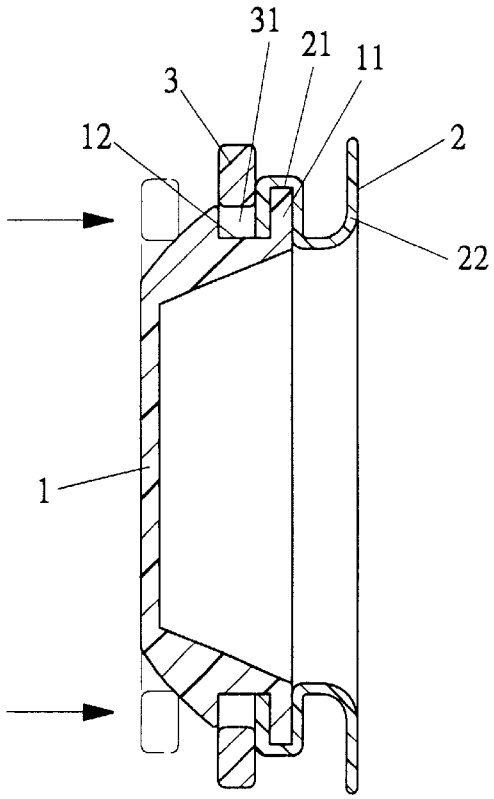
FIG. 3 is a sectional view illustrating assembly of the pair of waterproof goggles in accordance with the present invention.
Figure 4:
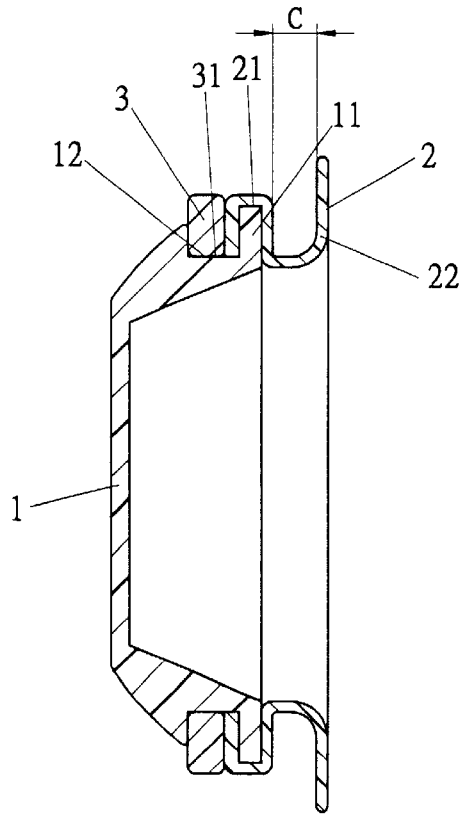
FIG. 4 is a sectional view similar to FIG. 3, wherein the pair of waterproof goggles is in an assembled state.
Figure 5:
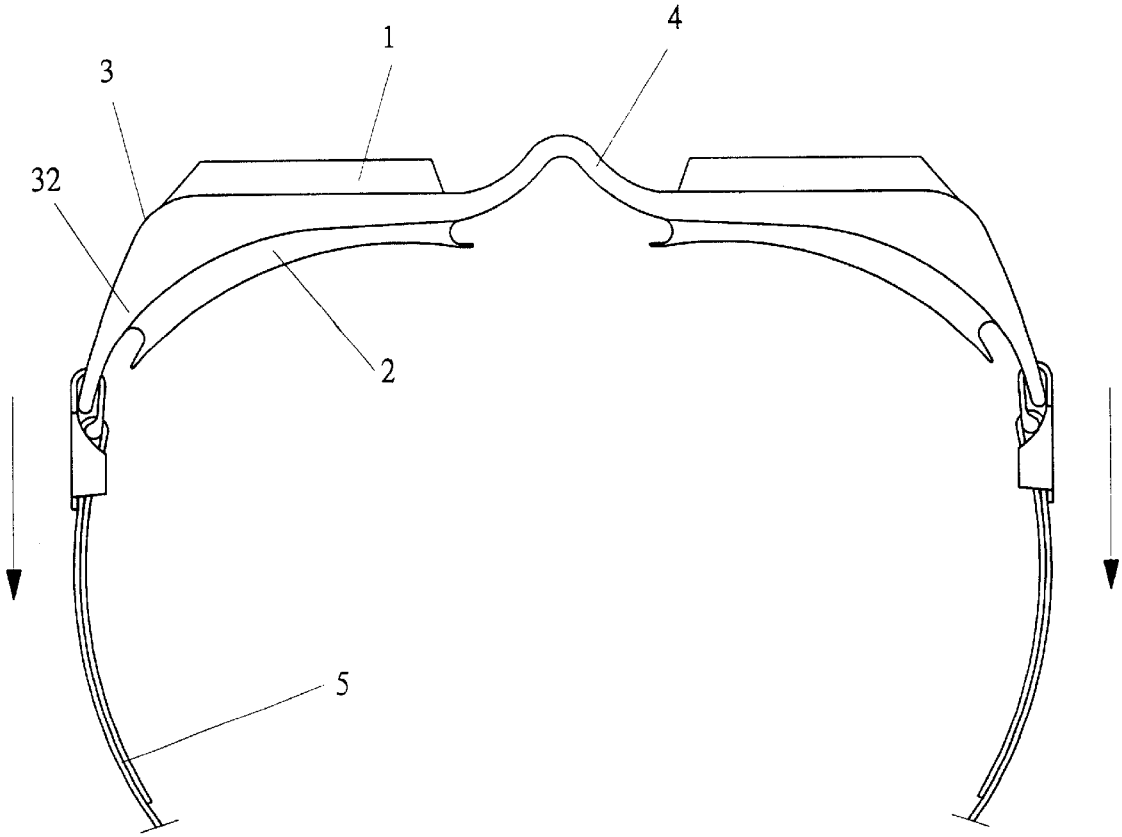
FIG. 5 is a top view of the pair of waterproof goggles in accordance with the present invention.

In assembly, as illustrated in FIGS. 3 and 4, each lens 1 is assembled to the associated padding member 2. Next, the receiving portion 31 of each frame 3 is slightly stretched outward to allow mounting of the receiving portion 31 into the annular groove 12 of the associated lens 1 with a side of the receiving portion 31 abutting against a side of the engaging portion 21 of the associated padding member 2. Further, an inner edge of each frame 3 is completely received in the annular groove 12 of the associated lens 1. Thus, the assembly is more reliable and more convenient while the padding portion 22 of each padding member 2 is away from the engaging portion 21 (see the distance in FIGS. 4). Further, since the diameter of each lens 1 is smaller, slight stretching of the associated frame 3 is sufficient to allow mounting of the frame 3 into the annular groove 12 of the lens 1. This permits manufacture of the frames 3 with a material that is less stretchable. As illustrated in FIG. 5, when wearing, the frames 3 and the bridge 4 that are less stretchable provide improved pull-resistance, thereby reducing the deformation of the frames 3 and the bridge 4 resulting from pulling of the head strap 5.

Figure 6:
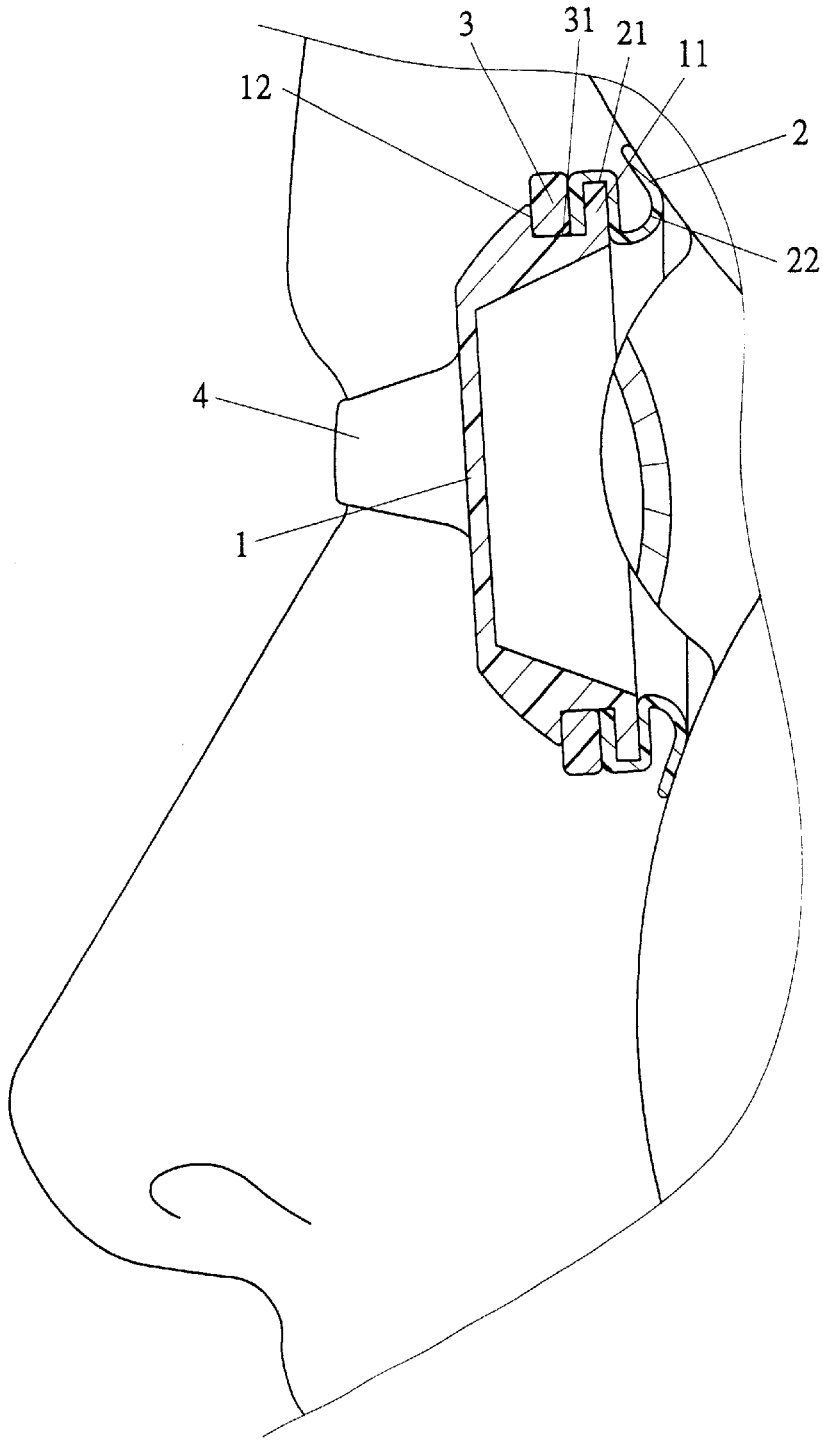
FIG. 6 is a partly sectioned schematic view illustrating use of the pair of waterproof goggles in accordance with the present invention.
Figure 13:
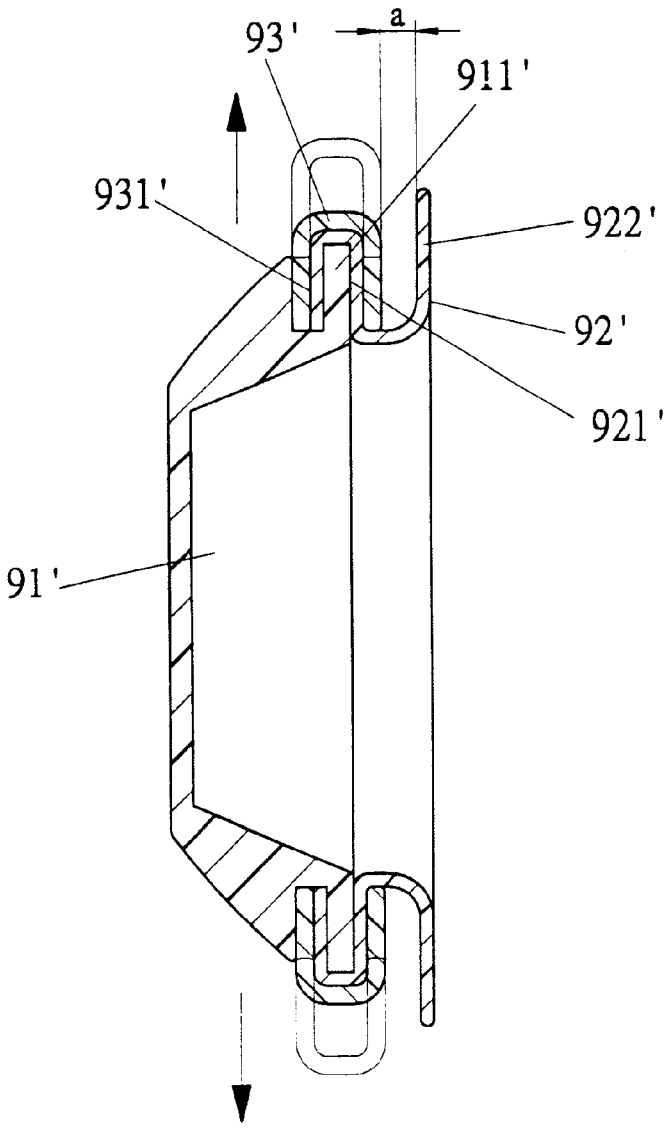
F I G . 13(PRIOR ART)
FIG. 13 is a sectional view of the pair of waterproof goggles in FIG. 12.
Figure 14:
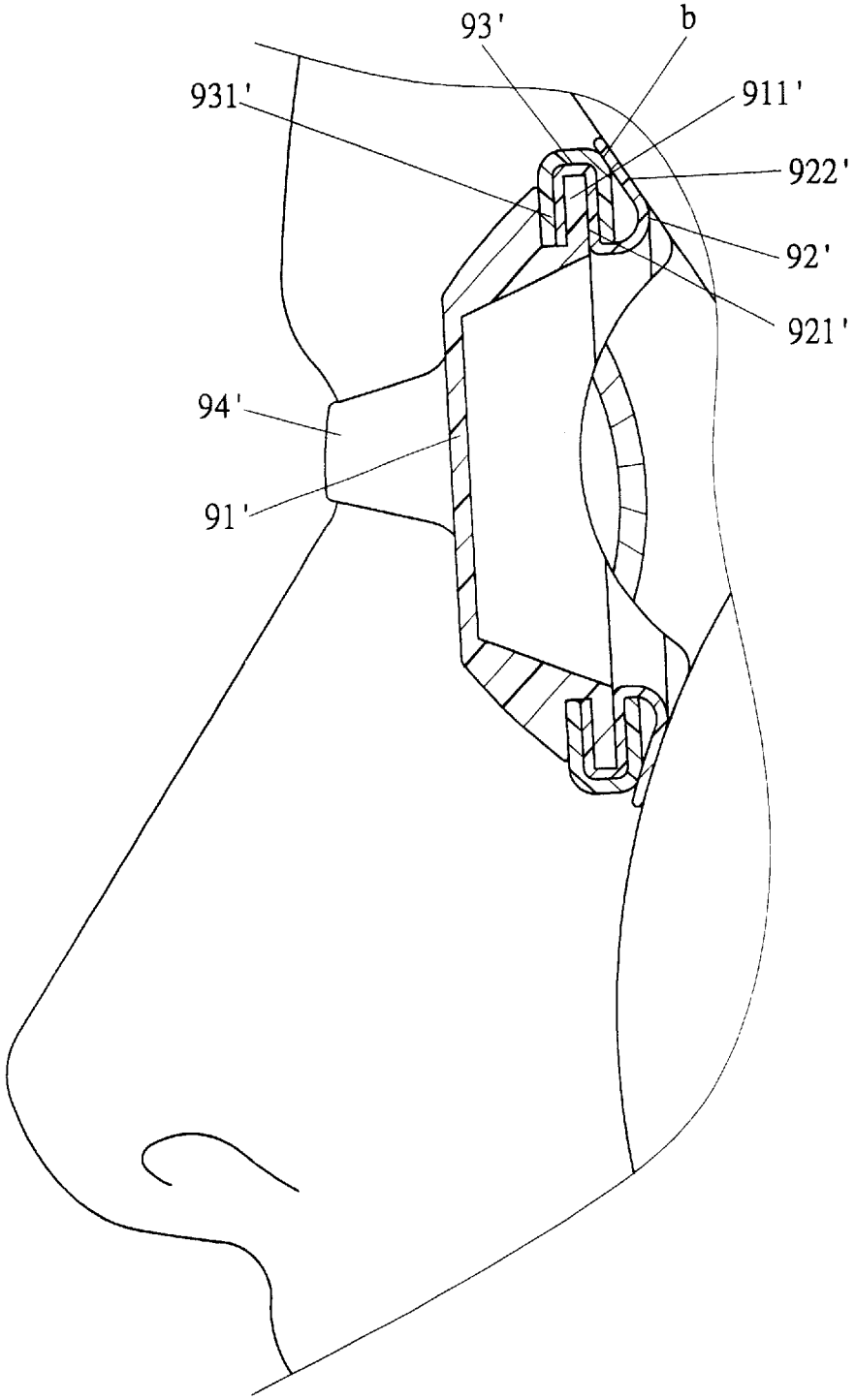
F I G . 14(PRIOR ART)
FIG. 14 is a partly sectioned schematic view illustrating use of the pair of waterproof goggles in FIG. 12.

Referring to FIG. 6, when in use, since the padding portion 22 of each soft padding member 2 is away from the engaging portion 21 (c.f. FIG. 13), the user's eye socket is in intimate contact with the soft padding portion 22 without pressing against the rigid lens 1. The wearing comfort is thus improved.

Figure 7:
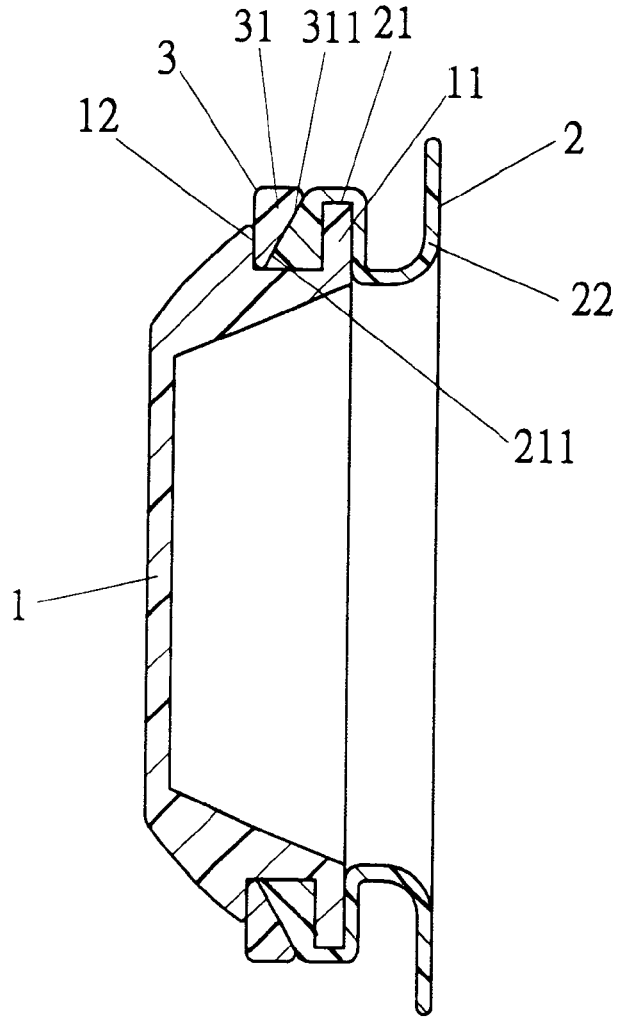
FIG. 7 is a sectional view illustrating a modified embodiment of the pair of waterproof goggles in accordance with the present invention.
Figure 8:
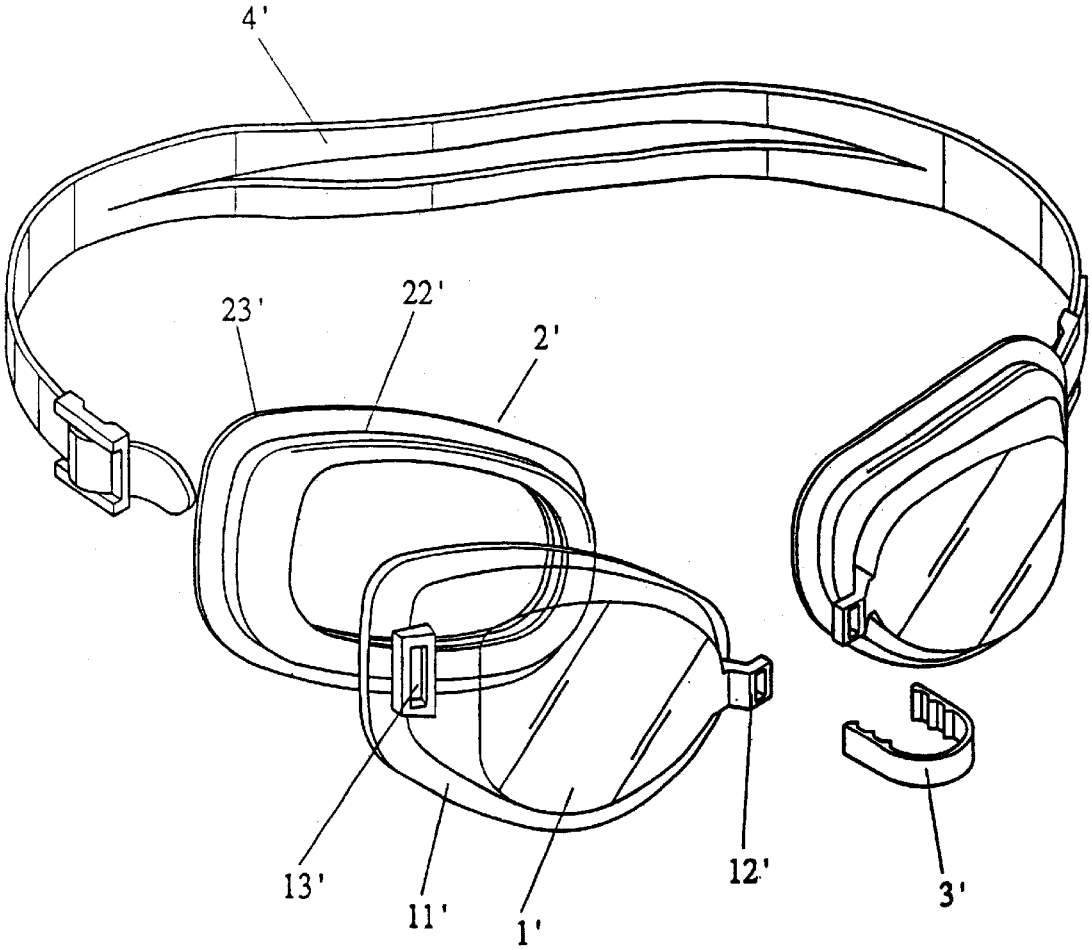
F I G . 8(PRIOR ART)
FIG. 8 is an exploded perspective view of a pair of conventional waterproof goggles.
Figure 9:
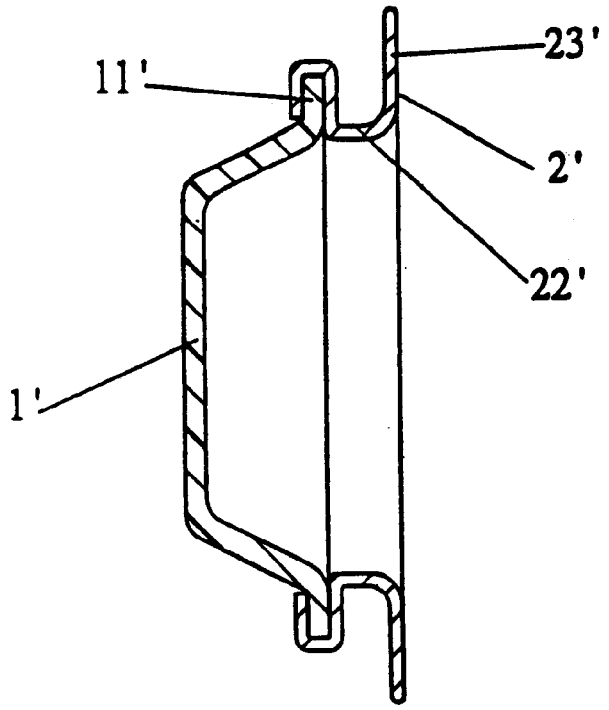
F I G . 9(PRIOR ART)
FIG. 9 is a sectional view of the pair of waterproof goggles in FIG. 8.
Figure 10:
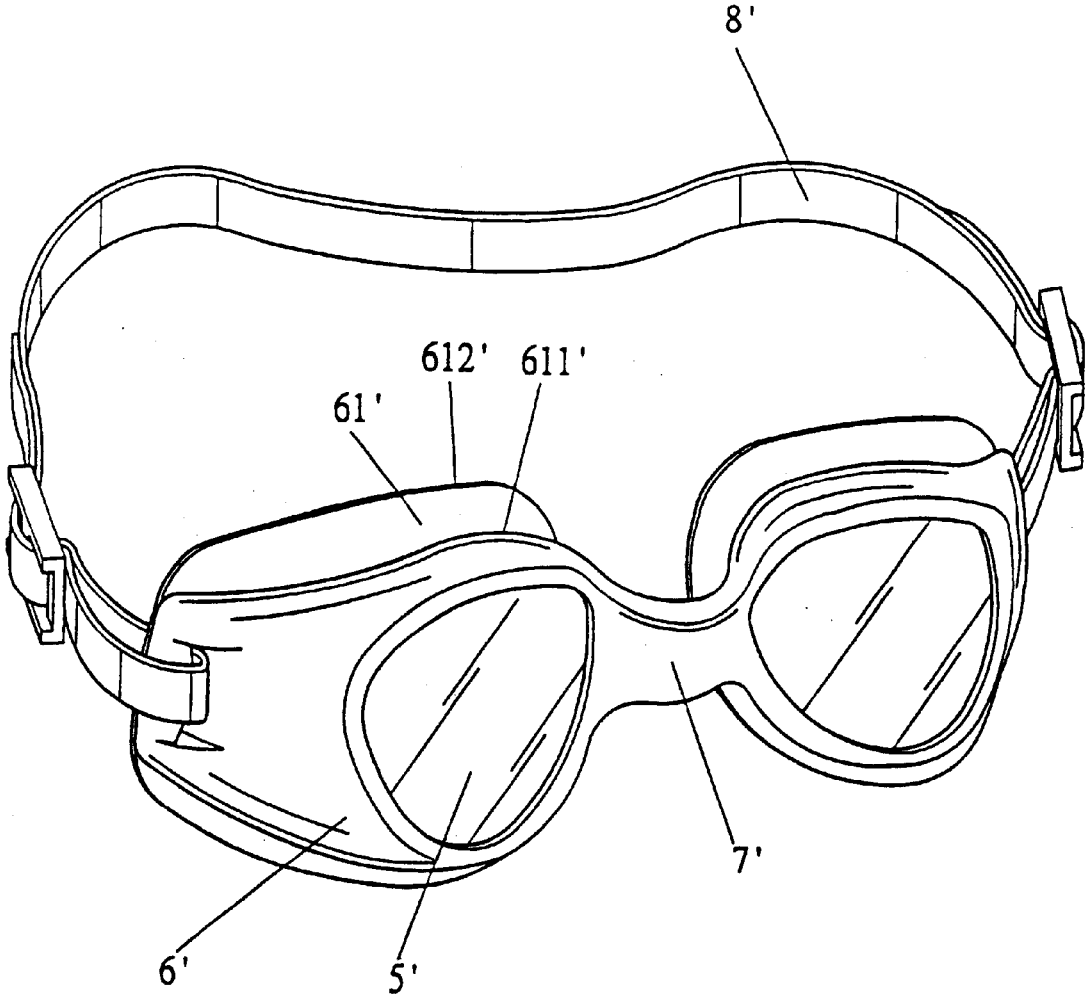
F I G . 10(PRIOR ART)
FIG. 10 is a perspective view of another pair of conventional waterproof goggles.
Figure 11:
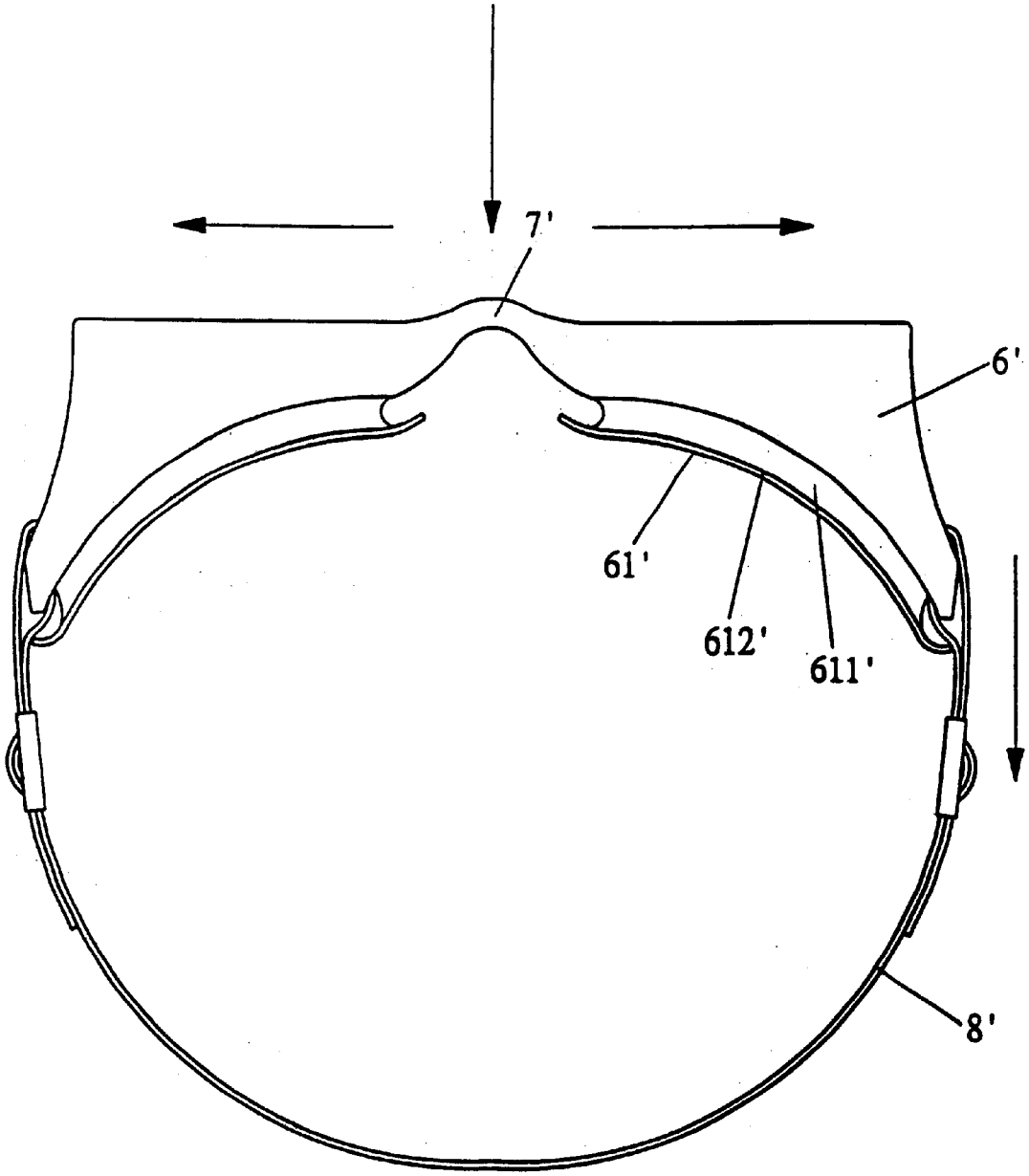
F I G . 11(PRIOR ART)
FIG. 11 is a top view of the pair of waterproof goggles in FIG. 10.
Figure 12:
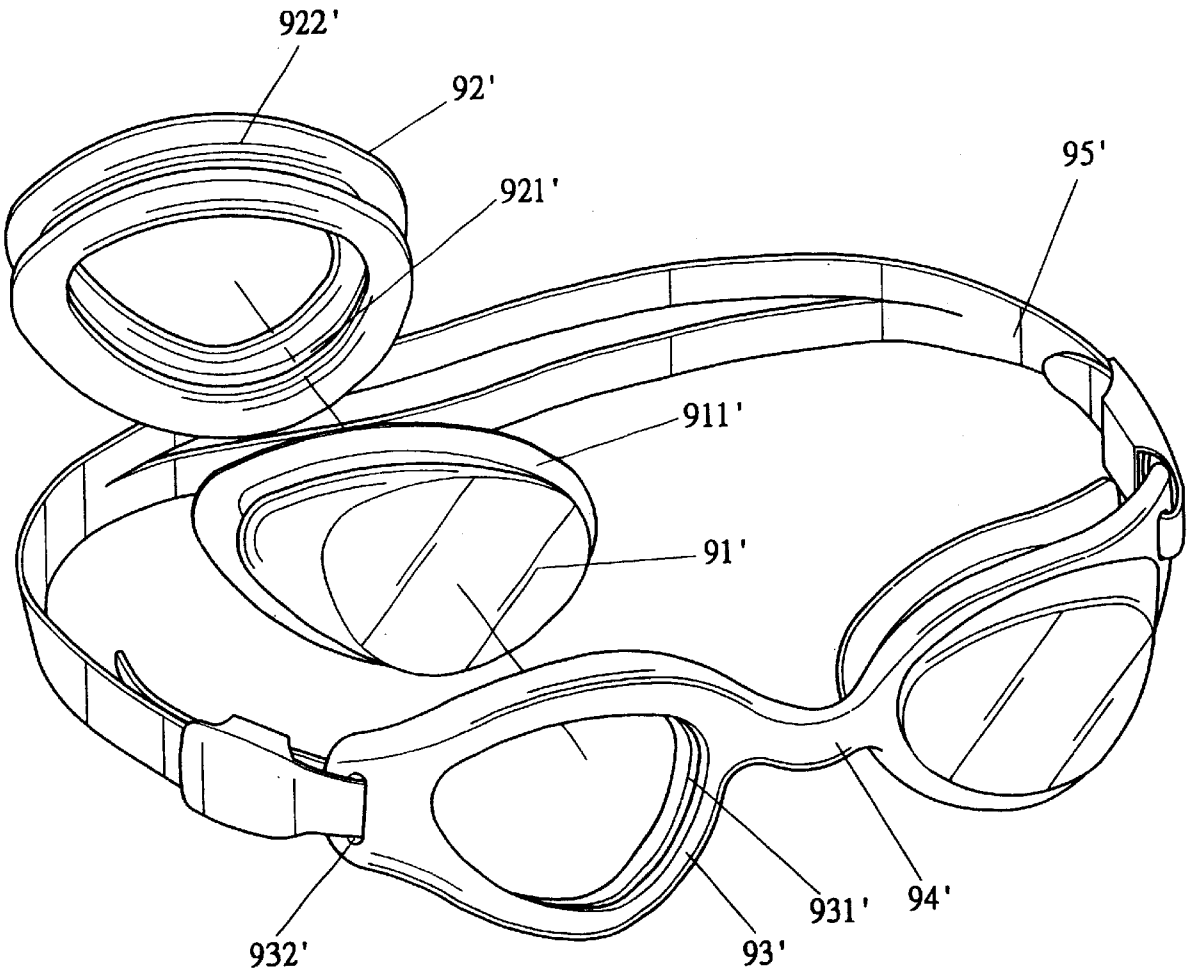
FIG. 12(PRIOR ART)
FIG. 12 is a perspective view, partly exploded, of a further pair of conventional waterproof goggles.

FIG. 7 illustrates a modified embodiment of the invention, wherein the engaging portion 21 of each padding member 2 has an inclined abutting face 211, and the receiving portion 31 of the associated frame 3 has a complimentary abutting face 311 such that the inclined abutting face 211 of the padding member 2 is in tight face-to-face engagement with the complimentary abutting face 311 of the associated frame 3. The receiving portion 31 of the frame 3 presses against the engaging portion 21 of the associated padding member 2 to thereby improve the assembling reliability for the padding member 2.

According to the above description, it is appreciated that the pair of waterproof goggles in accordance with the present invention has improved convenience of assembly, reliability, support, and wearing comfort. The frames 3 are made of a material that is less stretchable to provide improved pull-resistance against deformation.

Although the invention has been explained in relation to its preferred embodiment, it is to be understood that many other possible modifications and variations can be made without departing from the scope of the invention as hereinafter claimed.

What is claimed is:

1. A pair of waterproof goggles comprising two lenses made of a transparent rigid material, two padding members made of a soft material, two frames, a bridge, and a head strap, each said lens including a flange on a side thereof, each said lens further including an annular groove in an outer periphery thereof, each said padding member including an engaging portion on a side thereof for receiving the flange of an associated one of said lenses, said engaging portion having an inner diameter smaller than a diameter of the flange of an associated one of said lens, each said padding member further including a padding portion configured to conform a contour of a user's face, said frames and said bridge being integrally formed of a material that is slightly stretchable, each said frame including an outer portion for engaging with an associated end of said head strap, each said frame further including a receiving portion for clamping a bottom wall defining said annular groove of an associated one of said lenses, each said frame having an inner edge that is completely received in said annular groove of the associated lens, thereby allowing easy, reliable assembly and providing improved pull-resistance through use of said slightly stretchable frames, said padding portion of each said padding member having a distance to said engaging portion of said padding member to thereby prevent said padding portion from pressing against an associated one of said rigid lenses, allowing wearing comfort.

2. The pair of waterproof goggles as claimed in claim 1, wherein said engaging portion of each said padding member has an inclined abutting face, and wherein said receiving portion of each said frame has a complimentary abutting face such that said inclined abutting face of each said padding member is in tight face-to-face engagement with said complimentary abutting face of an associated one of said frames, said engaging portion of an associated one of said padding members to thereby improve the assembling reliability for said padding members.

3. A pair of waterproof goggles comprising two lenses made of a transparent rigid material, two padding members made of a soft material, two frames, a bridge, and a head strap, each said lens including an annular groove in an outer periphery thereof, each said padding member including an engaging portion on a side thereof for receiving the flange of an associated one of said lenses, said engaging portion having an inner diameter smaller than a diameter of the flange of an associated one of said lens, each said padding member further including a padding portion configured to conform a contour of a user's face, said frames and said bridge being integrally formed of a material that is slightly stretchable, each said frame including an outer portion for engaging with an associated end of said head strap, each said frame further including a receiving portion for clamping a bottom wall defining said annular groove of an associated one of said lenses, each said frame having an inner edge that is completely received in said annular groove of the associated lens, thereby allowing easy, reliable assembly and providing improved pull-resistance through use of said slightly stretchable frames, said padding portion of each said padding member having a distance to said engaging portion of said padding member to thereby prevent said padding portion from pressing against and associated one of said rigid lenses, allowing wearing comfort wherein said engaging portion of each said padding member has an inclined abutting face, and wherein said receiving portion of each said frame has a complimentary abutting face such that said inclined abutting face of each said padding member is in tight fact-to-face engagement with said complimentary abutting face of an associated one of said frames, said receiving portion of each said frame pressing against said engaging portion of an associated one of said padding members to thereby improve the assembling reliability for said padding members.

* * * * *